US006929263B2

(12) United States Patent
Scott et al.

(10) Patent No.: US 6,929,263 B2
(45) Date of Patent: Aug. 16, 2005

(54) GOLF TRIVIA BOARD GAME FOR ONE OR MORE PLAYERS AND METHOD THEREFOR

(76) Inventors: David Michael Scott, 75 N. Valley Verde Dr., Apt. 2013, Henderson, NV (US) 89074; Cheryl A. Draper, 75 N. Valle Verde Dr., Apt. 2013, Henderson, NV (US)

( * ) Notice: Subject to any disclaimer, the term of this patent is extended or adjusted under 35 U.S.C. 154(b) by 0 days.

(21) Appl. No.: 10/440,534

(22) Filed: May 19, 2003

(65) Prior Publication Data

US 2004/0232614 A1 Nov. 25, 2004

(51) Int. Cl.[7] ..... A63F 3/00
(52) U.S. Cl. ..... 273/245; 273/259; 273/277
(58) Field of Search ..... 273/245, 259, 273/277, 429, 430, 431; 434/128, 129

(56) References Cited

U.S. PATENT DOCUMENTS 5,000,460 A * 3/1991 Barbiaux et al. ..... 273/245
5,692,751 A * 12/1997 Morrissey et al. ..... 273/245
6,409,171 B1 * 6/2002 Schultz et al. ..... 273/245

OTHER PUBLICATIONS

Ex. Parte Breslow 192 USPQ 431.*

* cited by examiner

*Primary Examiner*—Vishu K. Mendiratta
(74) *Attorney, Agent, or Firm*—Craig Weiss; Veronica-Adele R. Cao; Weiss, Moy & Harris, P.C.

(57) ABSTRACT

A golf trivia board game for one or more players and method therefor in which players must answer golf trivia questions of various topics in order to advance a player token over a golf course depicted on a game board. Trivia questions have a degree of difficulty relative to a degree of difficulty for a specific golf shot that the player faces in order to advance his or her player token through a specific golf hole. The object of the game is to advance the player token completely across the golf course in a fewest possible number of questions.

15 Claims, 4 Drawing Sheets

| | PAR 4 TEE SHOT (36, 30) |
|---|---|
| GH | THE FIRST SET OF "GOLF RULES" WERE KNOWN AS? (32) |
| RG | WHAT IS THE MAXIMUM NUMBER OF CLUBS A PLAYER CAN HAVE IN THEIR BAG? (32) |
| PGT | WHO WAS THE FIRST PGA PLAYER TO WIN OVER $1 MILLION IN A CAREER? (32) |
| GCT | AUGUSTA NATIONAL IS HOME TO THE PGA CHAMPIONSHIP. T or F (32) |
| PGT | WHO HOLDS THE BEST SAND SAVE RECORD TO DATE? (32) |
| | PAR TEE GOLF |

FIG. 6

| | (34, 30) |
|---|---|
| GH | THE THIRTEEN ARTICLES (34) |
| RG | 14 (34) |
| PGT | ARNOLD PALMER (34) |
| GCT | FALSE (THE MASTERS) (34) |
| PGT | MIKE SCOTT (34) |
| CORRECT | YOU ARE 150 YDS. FROM THE GREEN IN THE MIDDLE OF THE FAIRWAY |
| INCORRECT | YOU ARE IN THE LEFT ROUGH 175 YDS FROM THE GREEN BEHIND A TREE. |

FIG. 7

GOLF TRIVIA BOARD GAME FOR ONE OR MORE PLAYERS AND METHOD THEREFOR

FIELD OF THE INVENTION

This invention relates generally to sports trivia board games and, more specifically, to a golf trivia board game and method therefor for one or more players in which a player moves a player token hole by hole across a golf course graphically depicted on a game board by successfully answering questions having a degree of difficulty relative to a degree of difficulty for a specific golf shot that the player faces in order to advance his or her player token through a specific golf hole.

BACKGROUND OF THE INVENTION

Due to the popularity of sports, such as golf, tennis, soccer, basketball, football, baseball, and hockey, there are many knowledgeable fans who enjoy reading about and/or watching these sporting events. Fans often enjoy testing their knowledge of various sports by playing trivia games in which they must answer questions on various topics and of varying degrees of difficulty. Many trivia games require players to answer questions correctly in order to advance a player token over a game board. As a result, the player with the most correct answers often emerges victorious. Like sports itself, many board games involve an element of chance in addition to the sports knowledge that a player must demonstrate in order to be successful. However, most sports trivia board games, and golf trivia board games particularly, stop there, without requiring a player to implement a knowledge of sports strategy, or particularly golf strategy, along with sports trivia knowledge.

A need therefore existed for a golf trivia board game and method therefor for entertaining one or more players capable of allowing a player to test his or her knowledge of golf trivia as well as golf strategy.

SUMMARY OF THE INVENTION

An object of the present invention is to provide a sports trivia board game for one or more players capable of testing both a player's sports knowledge and sports strategy.

It is a further object of the present invention to provide a golf trivia board game and method therefor having a graphical representation of a golf course and a plurality of cards having questions with a degree of difficulty relative to a degree of difficulty for a specific golf shot.

It is a still further object of the present invention to provide a golf trivia board game and method therefor wherein the object of the game is to advance a player token completely across a golf course depicted on a game board in a fewest possible number of questions.

BRIEF DESCRIPTION OF THE PREFERRED EMBODIMENTS

In accordance with one embodiment of the present invention, a golf trivia board game is disclosed, comprising, in combination, a game board having a graphical representation of a golf course, at least one player token, and a plurality of cards, each card of the plurality of cards having at least one question and at least one answer corresponding to the at least one question, each card of the plurality of cards having a category corresponding to a specific golf shot, the at least one question of each card having a degree of difficulty relative to a degree of difficulty for the specific golf shot, wherein at least one player answers a question from one of the plurality of cards corresponding to a specific golf shot that the at least one player faces in order to advance the player token a distance through a specific golf hole of the golf course of the game board, a correct answer allowing the player token to be advanced to a first pre-determined location closer to a pin of the specific golf hole and an incorrect answer allowing the player token to be advanced to a second pre-determined location closer to a pin, the first pre-determined location being closer to the pin than the second pre-determined location, and wherein an object of the golf trivia board game being to advance the player token completely across the golf course in a fewest possible number of questions.

In accordance with another embodiment of the present invention, a method for playing a golf trivia board game is disclosed, comprising, in combination, the steps of providing a game board having a graphical representation of a golf course, providing a plurality of cards, each card of the plurality of cards having at least one question and at least one answer corresponding to the at least one question, each card of the plurality of cards having a category corresponding to a specific golf shot, the at least one question of each card having a degree of difficulty relative to a degree of difficulty for the specific golf shot, providing at least one player token, and at least one player selecting one of the plurality of cards from a category corresponding to a specific golf shot that the at least one player faces in order to advance the player token a distance through a specific golf hole of the golf course of the game board, the at least one player answering a question from one of the plurality of cards corresponding to a specific golf shot that the at least one player faces in order to advance the player token a distance through a specific golf hole of the golf course of the game board, the at least one player advancing the player token to one of a first pre-determined location closer to a pin of the specific golf hole for a correct answer and a second pre-determined location closer to a pin of the specific golf hole for an incorrect answer, the first pre-determined location being closer to the pin than the second pre-determined location, and wherein an object of the golf trivia board game being to advance the player token completely across the golf course in a fewest possible number of questions.

In accordance with yet another embodiment of the present invention, a sports trivia board game is disclosed, comprising, in combination, a game board having a graphical representation of a sports field, at least one player token, and a plurality of cards, each card of the plurality of cards having at least one question and at least one answer corresponding to the at least one question, each card of the plurality of cards having a category corresponding to a specific sports activity, the at least one question of each card having a degree of difficulty relative to a degree of difficulty for the specific sports activity, wherein at least one player answers a question from one of the plurality of cards corresponding to a specific sports activity that the at least one player faces in order to advance the player token a distance over the sports field of the game board, a correct answer allowing the player token to be advanced to a first pre-determined location closer to a goal of the sports field and an incorrect answer allowing the player token to be advanced to a second pre-determined location closer to a goal, the first pre-determined location being closer to the goal than the second pre-determined location, wherein an object of the sports trivia board game being to advance the player token completely across the game board in a fewest possible number of questions.

The foregoing and other objects, features, and advantages of the invention will be apparent from the following, more particular description of the preferred embodiments of the invention, as illustrated in the accompanying drawings.

BRIEF DESCRIPTION OF THE DRAWINGS

FIG. 6 is a top view of a sample card of the present invention, showing a plurality of questions for a Par 4 Tee Shot.

FIG. 7 is a bottom view of the sample card of FIG. 6, showing the corresponding answers to the questions shown in FIG. 6 along with the resulting position the player's token is to be moved if the question is answered correctly or incorrectly.

DETAILED DESCRIPTION OF THE PREFERRED EMBODIMENTS

Figure 1:
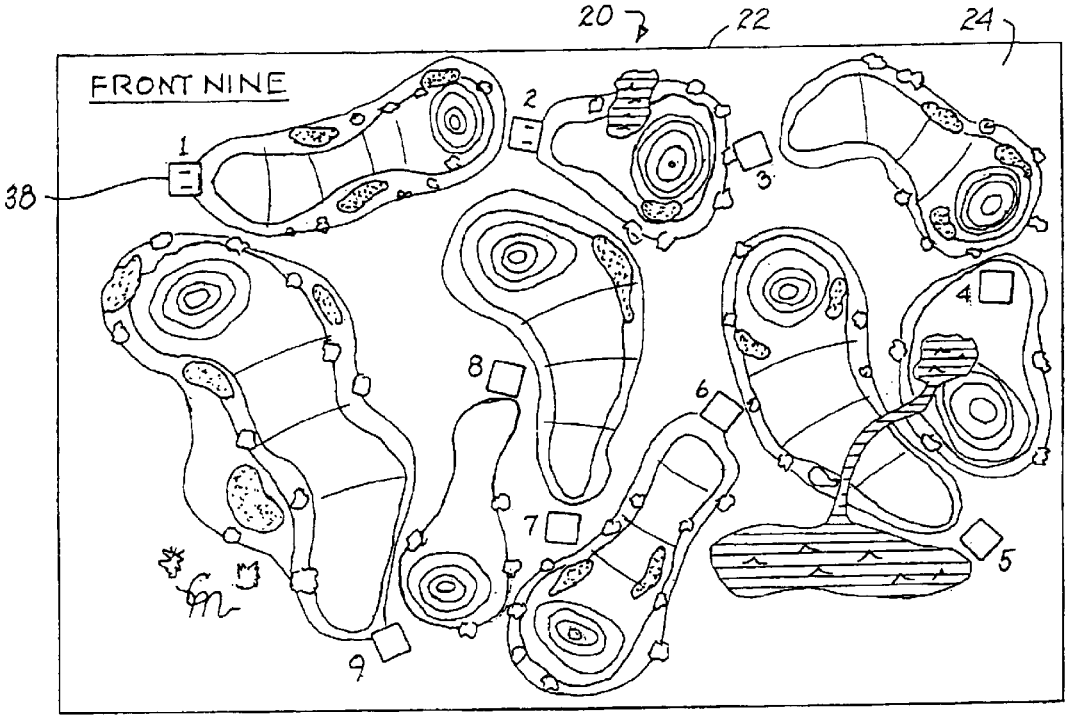
FIG. 1 is a top view of the preferred embodiment of the golf trivia board game of the present invention, showing the front nine golf holes of the golf course located on the front side of the game board.
Figure 2:
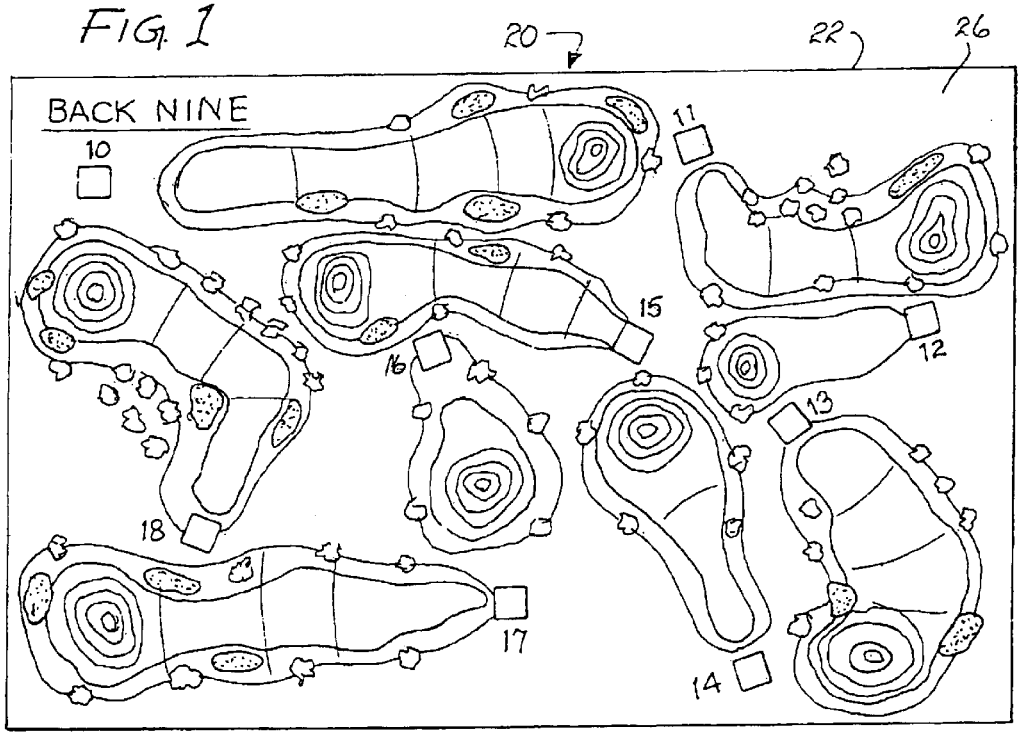
FIG. 2 is a bottom view of the preferred embodiment of the golf trivia board game of the present invention, showing the back nine golf holes of the golf course located on the bottom side of the game board.

Referring to FIGS. 1–2, the golf trivia board game of the present invention, hereinafter golf trivia board game 20, is shown. The golf trivia board game 20 comprises a game board 22 having a graphical representation of a golf course. Preferably, the game board 22 has a top surface 24 depicting a front nine golf holes (labeled 1–9 in FIG. 1) and a bottom surface 26 depicting a back nine golf holes (labeled 10–18 in FIG. 2). However, it should be clearly understood that substantial benefit could be derived from an alternative embodiment of the golf trivia board game 20 in which eighteen holes of the golf course are shown on only the top surface 24 of the game board 22, or shown in an alternative format altogether, such as on a computer screen.

Figures 3, 4, 5:
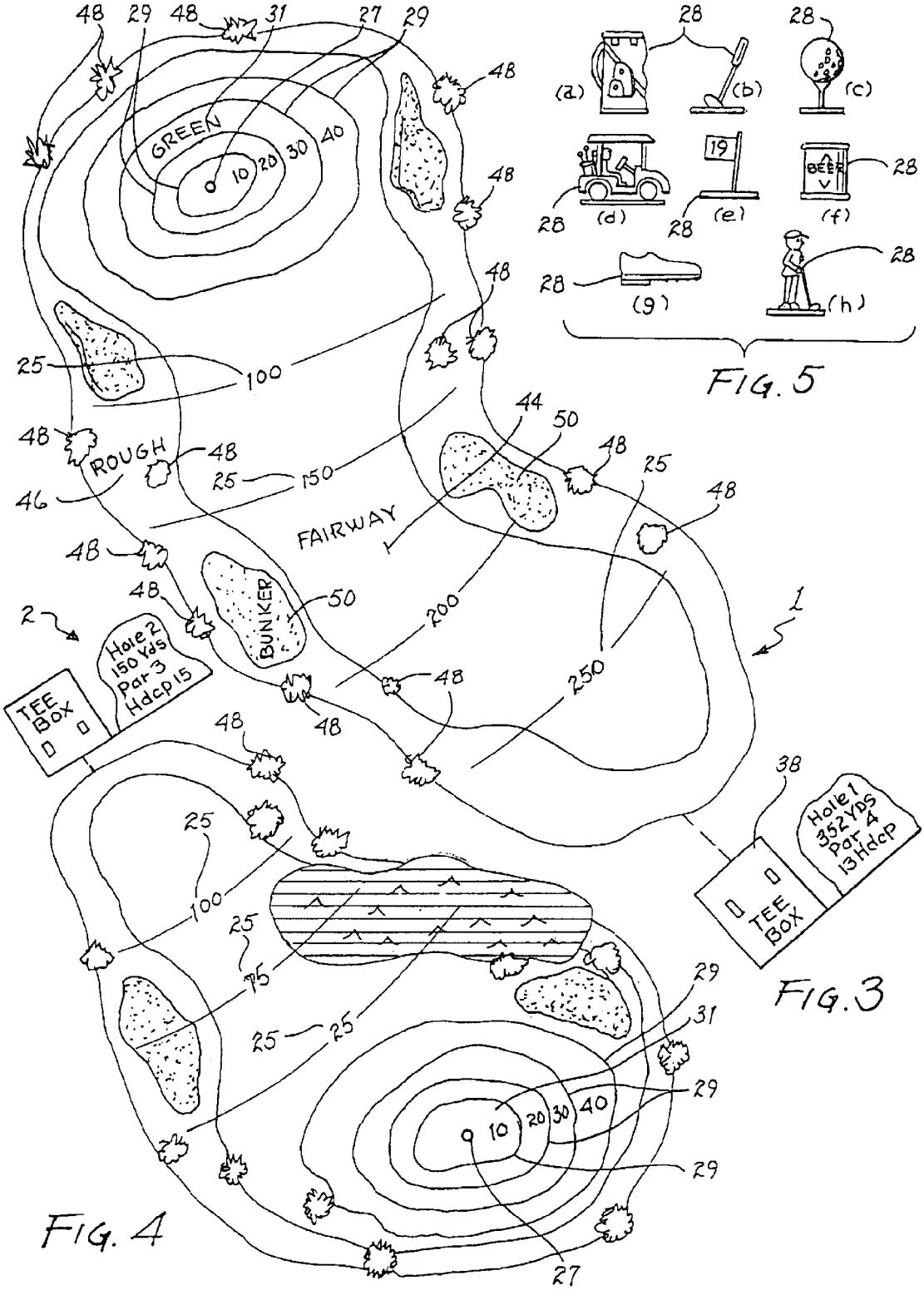
FIG. 3 is an enlarged top view of the first hole of the golf course on the game board of the golf trivia board game, showing "rough" and "bunker" hazards, indicia indicating distances to the pin as well as concentric circles on the green indicating a distance to the pin
FIG. 4 is an enlarged top view of the second hole of the golf course on the game board of the golf trivia board game, showing indicia indicating distances to the pin as well as concentric circles on the green indicating a distance to the pin
FIG. 5 is a front list view of sample player tokens of the preferred embodiment of the golf trivia board game of the present invention.

Referring now to FIG. 5, the golf trivia board game 20 further comprises at least one player token 28. In the preferred embodiment, there are eight player tokens (as shown in FIG. 5); a golf bag (28*a*); a golf club (28*b*); a golf ball (28*c*); a golf cart (28*d*); a golf flag (28*e*); a beer can (28*f*); a golf shoe (28*g*) and a golfer (28*h*), although it should be clearly understood that substantial benefit could be derived from an alternative configuration of the golf trivia board game 20 in which player tokens other than the ones shown in FIG. 5 are used (for example a golf glove instead of the beer can 28*f*, etc.), or in which the at least one player token 28 is graphically represented on a computer screen.

Referring now to FIGS. 3–4, a sample golf hole 1 and a sample golf hole 2 are shown, respectively. In the preferred embodiment, each of the eighteen golf holes includes indicia 25 indicating a distance to a pin 27 of the golf hole. Preferably, the distance is represented in yards, just like on an actual golf hole. Preferably, each pin 27 is surrounded by a plurality of concentric circles 29 on the green 31 indicating a distance from one of the concentric circles 29 to the pin 27, preferably in feet. While, in the preferred embodiment, the golf trivia board game 20 includes indicia 25 and concentric circles 29 to mark the distance from a point on the golf hole to the pin 27, it should be clearly understood that substantial benefit could be derived from an alternative configuration of the golf trivia board game 20 in which the distance is marked in another way, such as by communication between the player token 28 and the pin 27, or in which there is no indicia 25 or concentric circles 29 at all.

Referring now to FIGS. 6–7, the golf trivia board game 10 further comprises a plurality of cards 30. Each card 30 has at least one question 32, and preferably a plurality of questions 32, as shown in FIG. 6. In the preferred embodiment, the plurality of questions 32 are each of a different topic, preferably: "Golf History" (shown as "GH" in FIGS. 6–7); "Rules" (shown as "RG" in FIGS. 6–7); "Pro Golfers" (shown as "PGT" in FIGS. 6–7); "Golf Courses" (shown as "GCT" in FIGS. 6—7); and "Statistics" (not shown). However, it should be clearly understood that other topics could be added or substituted for the preferred topics listed above. Each card 30 also has at least one answer 34 (shown in FIG. 7) corresponding to the at least one question 32. In the preferred embodiment, each card 30 has a front side 31 having the at least one question 32 printed thereon, and a back side 33 having the at least one answer 34 printed thereon, although it should be clearly understood that substantial benefit could be derived from an alternative configuration of the golf trivia board game 20 in which the questions 32 and the answers 34 appear on the same side of the card 30 or in which they appear on a computer screen, or the like.

Each of the plurality of cards 30 have a category 36 (shown in FIG. 6 as a Par 4 Tee Shot) corresponding to a specific golf shot. In the preferred embodiment, the categories of the cards are: Par 5 Tee Shot; Par 4 Tee Shot; Par 3 Tee Shot; Par 5 Go For It (a player's 2nd shot on a Par 5, in which they attempt to reach the green); Par 5 Lay Up (a player's 2nd shot on a Par 5, in which they do not attempt to reach the green); 2nd Shot (if under 100 yards)/3rd Shot (if over 100 yards); Trouble Shot; Chip Shot; Bunker Shot; and Putting.

The degree of difficulty for the at least one question 32 is relative to a degree of difficulty for a specific golf shot. For example, in golf, a "Chip Shot" is easier than a "tee shot," and consequently, in the golf trivia board game 20 a "Chip Shot" question is easier than a "tee shot" question. Thus, with every question, the degree of difficulty corresponds directly to the degree of difficulty of a particular golf shot relative to other golf shots (e.g., a par 5 tee shot in golf is harder than a par 3 tee shot in golf, and thus a par 5 tee shot question is harder than a par 3 tee shot question in the golf trivia board game 20).

RULES OF PLAY

Figure 9:
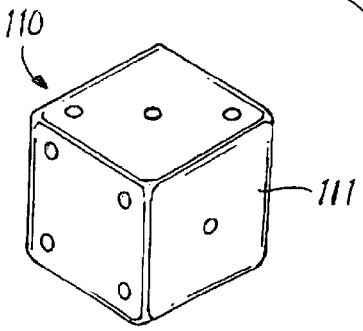
FIG. 9 is an elevated perspective view of a random number generator, a die, of the present invention.

In order to play the golf trivia board game 20, each player (not shown) begins by placing a player token 28 on the tee box 38 of the first hole (Shown in FIGS. 1 and 3 ). In the preferred embodiment, the golf trivia board game 20 comprises a random number generator 110 (shown in FIG. 9), such as a die 111 (shown in FIG. 9), for determining which player goes first. Each player then preferably rolls the die 111 and the player with the lowest (or alternatively the highest) number goes first. While, in the preferred embodiment, the golf trivia board game 20 comprises a random number generator 110. such as a die 111, it should be clearly understood that substantial benefit could be derived from an alternative configuration of the golf trivia board game 20 in which there is no random number generator 110 (or one other than a die 111 ) and the players find some other means for agreeing on who goes first.

Figure 8:
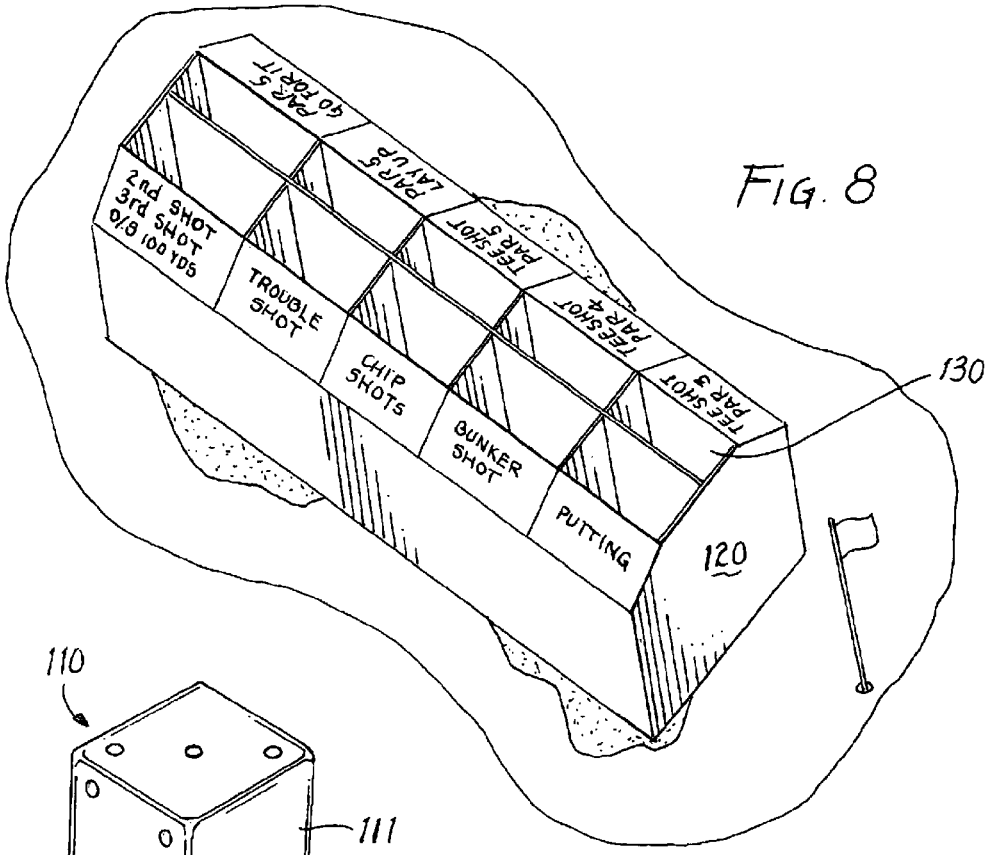
FIG. 8 is an elevated perspective view of a dispenser of the present invention, showing ten receptacles dimensioned to retain the plurality of cards. As shown, each receptacle is labeled according to the following golf shot categories: "par 5 tee shot," "par 4 tee shot," "par 3 tee shot," "par 5 go for it," "par 5 lay up," "2nd shot 3rd shot o/s 100 yards," "trouble shot," "chip shot," "bunker shot," and "putting."

The player going first then selects the card 30 corresponding to the shot that the player is about to take. In this case, the first hole (shown in FIG. 3) is a par 4. The first shot, therefore, must be a tee shot from a par 4. Thus, the first question 32 to be asked will be from the "Par 4 Tee Shot" card 30. In the preferred embodiment, the golf trivia board game 20 comprises at least one card dispenser . 120 (shown in FIGS. 8 and 111), defining a plurality of receptacles 130 (shown in FIG. 8 and 111) dimensioned to retain the plurality of cards 30. Each receptacle 130 preferably corresponds to each category of the plurality of cards 30. For example, in the preferred embodiment, there are ten separate categories for the cards 30 (Par 5 Tee Shot; Par 4 Tee Shot; Par 3 Tee Shot; Par 5 Go For It (a player's 2nd shot on a Par 5, in which they attempt to reach the green); Par 5 Lay UP (a player's 2nd shot on a Par 5, in which they do not attempt to reach the green); 2nd Shot (if under 100 yards)/3rd Shot (if over 100 yards); Trouble Shot; Chip Shot; Bunker Shot; and Putting), and thus there would be a need for one card dispenser 120 with ten corresponding receptacles 130, or preferably two card dispensers 120 of five receptacles 130 each. Thus, either the player going first (or another player designated to ask questions) would then take the appropriate card from the appropriate receptacle 130 of the card dispenser 120. While, in the preferred embodiment the golf trivia board game 20 comprises at least one card dispenser 120, it should be clearly understood that substantial benefit could be derived from an alternative configuration of the golf trivia board game 20 in which there is no card dispenser 120, such as with questions provided by a computer or computer-type device. Additionally, iL is within the spirit and scope of this invention that more or less than ten categories for the plurality of cards 30 could be used, for example the 2nd Shot (if under 100 yards)/3rd Shot (if over 100 yards) could be two separate categories of cards 30.

Figure 10:
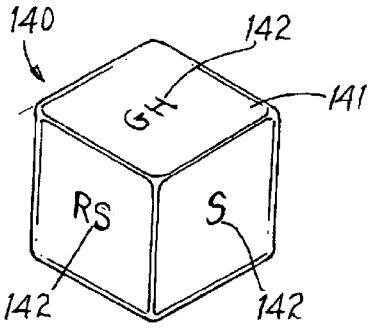
FIG. 10 is an elevated perspective view of a random topic generating mechanism, a die, for determining by chance the specific topic of the question to be asked. As shown, each face of the die preferably has a symbol corresponding to one of the question topics.
Figure 11:
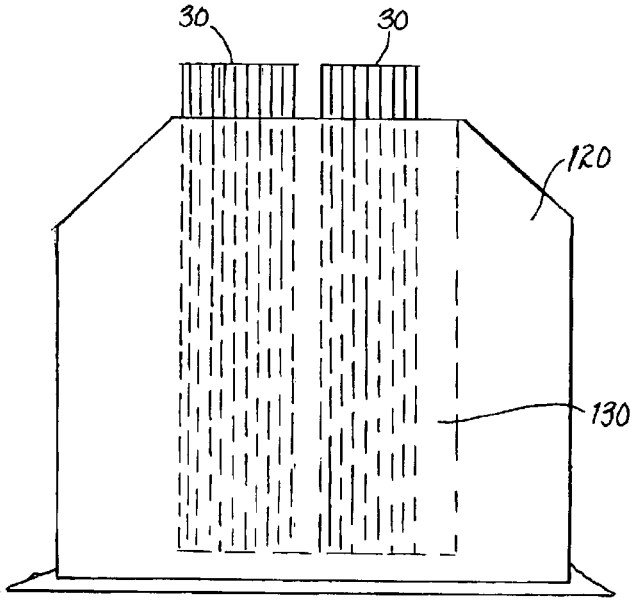
FIG. 11 is a side cross-sectional view of the dispenser of FIG. 8. As shown the receptacles are dimensioned to retain the plurality of cards.

In the preferred embodiment, the golf trivia board game 20 further comprises a random topic generating mechanism 140 (shown in FIG. 10), preferably a die 141 (shown in FIG. 10 ), for determining by chance a topic of the question 32 to be asked. Preferably, the die 141 would have a symbol 142 (shown in FIG. 9) on each face corresponding to the preferred question topics (such as: "H" or "GH" for "Golf History"; "R" or "RG" for "Rules"; "G" or "PG" for "Pro Golfers"; "GC" for "Golf Courses"; "S" for "Statistics"; and "PC" for "Player's Choice"). Before being asked a question, a player would preferably roll the die 141 in order to determine the topic of the question that he or she is to be asked. While, in the preferred embodiment, the golf trivia board game 20 comprises a random topic generating mechanism 140, it should be clearly understood that substantial benefit could be derived from an alternative configuration of the golf trivia board game 20 in which there is no random topic generating mechanism 140 (or one other than a die 141). For example, players may simply rotate topics or the topics could be placed as indicia on each golf hole.

If the player answers the question 32 correctly, the card 30 indicates to the player where to advance the player token 28. Correct answers call for the player token 28 to be placed closer to the pin 27, typically either on the green 31 or on the fairway 44 (shown in FIG. 3) (e.g., center of the fairway, the right side of the fairway or the left side of the fairway). Incorrect answers, on the other hand, call for the player token 28 to be placed: in the rough 46 (shown in FIG. 3) (the left rough, right rough or the rough behind the green), behind a tree 48 (shown in FIG. 3) (which will require the player to take his or her next question 32 from one of the "Trouble Shot" cards 30), in a bunker 50 (shown in FIG. 3) (which will require the player to take his or her next question 32 from one of the "Bunker Shot" cards 30), or not as close to the pin 27 as the player would have been had he or she answered the question 32 correctly. A sample list of instructions as to where the player token 28 should be placed for answering a question correctly is located at the end of this application in Addendum #1. A sample list of instructions as to where the player token 28 should be placed for answering a question incorrectly is located at the end of this application in Addendum #2.

As the player advances his or her player token 28 through the golf course on the game board 22, the player must select cards 30 that correspond to the specific golf shot that the player faces. For example, after "hitting" the par 4 tee shot on golf hole #1 (i.e. answering the question 32 for the "Par 4 Tee Shot" card 30), the player's next question 32 will likely come from the card 30 entitled "2nd Shot (if under 100 yards)/3rd Shot (if over 100 yards)." If, however, as a result of a prior incorrect answer, the player token 28 has been placed behind a tree 48 or in a fairway bunker 50, then the player must select a question 32 from the "Trouble Shot" card 30. The player continues to advance through the golf course, hole after hole, selecting questions 32 from cards 30 for: a "Par 3 Tee Shot" when beginning a par 3 hole, a "Par 4 Tee Shot" when beginning a par 4 hole, and a "Par 5 Tee Shot" when beginning a par 5 hole. After beginning these holes, the player will select the aforementioned "Second Shot/Third Shot" card 30 for a second shot on a Par 4 hole or a Par 3 hole, assuming that the player is either not required to select a "Trouble Shot" card 30 or on the green 31 (which requires the player to select a "Putting" card 30). If the hole is a Par 5 hole, then for the player's second shot the player preferably must select either the "Par 5-Lay Up" card 30 or the "Par 5-Go For It" card 30. The "Par 5-Lay Up" questions 32 are preferably easier than the "Par 5-Go For It" questions 32, however, a "Par 5-Lay Up" question will not allow a player token 28 to be advanced to the green 31. In this way, a player must evaluate his or her knowledge of golf trivia while at the same time make a strategic determination as to whether it is worth risking the attempt to answer correctly a tougher question when the result of an incorrect answer will often be a "Trouble Shot" card 30.

"Chip Shots" cards 30 are to be selected whenever the player token 28 is less than 100 yards from the green 31. "Putting" cards 30 are to be selected when whenever the player is actually on the green 31. Often, the player will complete the hole by selecting a "Putting" card 30. Any number of feet that is awarded as a result of an answered question (correct or incorrect) that is sufficient to reach the pin 27 completes the hole. For example, if the player token 28 is 30 feet from the pin 27 and the player answers a question correctly, the result of which being that the putt goes 40 feet, then the player has made the putt and has completed the hole. Additionally, if the player is 10 feet from the pin, than even an incorrect answer to a "Putting" card 30 results in completion of the hole.

After each hole, the number of questions that each player answered is preferably added up. Preferably, the golf trivia board game 20 comprises a scoring mechanism (not shown), such as a standard golf score card, for keeping score. It should be clearly understood, however, that substantial benefit could be derived from an alternative configuration of the golf trivia board game 20 in which score is kept electronically, or by some other means, or in which there is no scoring mechanism at all.

While the invention has been particularly shown and described with reference to preferred embodiments thereof, it will be understood by those skilled in the art that the foregoing and other changes in form and details may be made therein without departing from the spirit and scope of the invention. For example, although the golf trivia board game 20 has been directed to the sport of golf, it should be clearly understood that the golf sports trivia game 20 could be easily modified to cover additional sports, such as baseball, football, basketball, hockey, soccer, etc. In each of these other sports the same principles apply—a player is asked a question having a degree of difficulty relative to a degree of difficulty for a specific sports activity. In each case, a player token 28 would be advanced based on the answer to a question 32, with the goal being to advance the player token 28 completely across the game board in a fewest possible number of questions 32.

We claim:

1. A golf trivia board game consisting of, in combination:

a game board having a graphical representation of a golf course;

at least one player token; and a plurality of question cards, each card of said plurality of question cards having at least one question and at least one answer corresponding to said at least one question, each card of said plurality of question cards corresponding to a specific golf shot, each card of said plurality of question cards having a first pre-determined location printed on said card directing said at least one player token closer to a pin of a golf hole for a correct answer to said at least one question and a second pre-determined location printed on said card directing said at least one player token closer to a pin of a golf hole for an incorrect answer to said at least one question, said first pre-determined location being closer to said pin than said second pre-determined location;

wherein at least one player answers a question from one of said plurality of question cards corresponding to a specific golf shot that said at least one player faces in order to advance said player token a distance through a specific golf hole of said golf course of said game board.

2. The golf trivia board game of claim 1 wherein said plurality of cards include a front side and a back side, said front side having said at least one question printed thereon and said back side having said at least one answer corresponding to said at least question being printed thereon, said back side further comprising a first pre-determined location directing said at least one player token closer to a pin of a golf hole for a correct answer to said at least one question and a second pre-determined location directing said at least one player token closer to a gin of a golf hole for an incorrect answer to said at least one question, said first pre-deterrnined location being closer to said pin than said second pre-determined location.

3. The golf trivia board game of claim 1 wherein said graphical representation of a golf course includes eighteen golf holes, each golf hole of said eighteen holes includes indicia indicating a distance to a pin of said golf hole, each said pin being surrounded by a plurality of concentric circles indicating a distance from one of said plurality of concentric circles to said pin.

4. The golf trivia board game of claim 1 further comprising:

at least one card dispenser defining:

a first receptacle dimensioned to retain cards for a par 5 tee shot;

a second receptacle dimensioned to retain cards for a par 4 tee shot;

a third receptacle dimensioned to retain cards for a par 3 tee shot;

a fourth receptacle dimensioned to retain cards for a par 5 2nd shot attempt at the green; and a fifth receptacle dimensioned to retain cards for a par 5 2nd shot attempt to lay up;

a sixth receptacle dimensioned to retain cards for a 2nd shot if under 100 yards from a pin of said golf hole and a third shot if over 100 yards from said pin of said golf hole;

seventh receptacle dimensioned to retain cards for a trouble shot;

an eighth receptacle dimensioned to retain cards for a chip shot;

a ninth receptacle dimensioned to retain cards for a bunker shot; and a tenth receptacle dimensioned to retain cards for a putting attempt;

said at least one player selecting one of said plurality of cards from one of said first receptacle, second receptacle, third receptacle, fourth receptacle, fifth receptacle, sixth receptacle, seventh receptacle, eighth receptacle, ninth receptacle and tenth receptacle corresponding to a specific golf shot that said at least one player faces in order to advance said player token through a specific golf hole of said golf course of said game board.

5. A method for playing a golf trivia board game comprising, in combination, the steps of:

providing a game board having a graphical representation of a golf course;

providing at least one player token;

providing a plurality of question cards, each card of said plurality of question cards belonging to a category corresponding to a specific golf shot and having:

at least one question and at least one answer corresponding to said at least one question printed on said card, said at least one question and said at least answer being of a specific topic;

a first pre-determined location printed on said card directing said at least one player token closer to a pin of a golf hole for a correct answer to said at least one question; and a second pre-determined location printed on said card directing said at least one player token closer to a pin of a golf hole for an incorrect answer to said at least one question, said first pre-determined location being closer to said pin than said second pre-determined location;

providing a random topic generating mechanism for determining by chance said topic of said at least one question;

at least one player determining a specific golf shot that said at least one player faces in order to advance said player token a distance through a specific golf hole of said golf course of said game board;

said at least one player selecting one of said plurality of cards from a category corresponding to said specific golf shot that said at least one player faces in order to advance said player token a distance through a specific golf hole of said golf course of said game board;

said at least one player answering a question of said topic generated by said random topic generating mechanism from one of said plurality of cards corresponding to said specific golf shot that said at least one player faces in order to advance said player token a distance through a specific golf hole of said golf course of said game board;

said at least one player advancing said player token to one of said first pre-determined location for a correct answer and said second pre-determined location for an incorrect answer; and wherein an object of said golf trivia board game being to advance said player token completely across said golf course in a fewest possible number of questions.

6. The method of claim 5 further comprising the steps of:

providing a random number generator for determining which player goes first; and a player with a lowest number from said random number generator answering a first question.

7. The method of claim 6 wherein said random number generator comprises a die and wherein each said player rolls said die to determine which player goes first.

8. The method of claim 5 wherein said random topic generating mechanism comprises at least one die having characters thereon corresponding to individual topics of each of said at least one question.

9. The method of claim 5 wherein said plurality of cards include a front side and a back side, said front side having said at least one question printed thereon end said back side having said at least one answer corresponding to said at least question being printed thereon, and wherein said at least one player reads said at least one question and wherein said at least one player answers said at least one question.

10. The method of claim 5 further comprising the steps of:

providing a scoring mechanism for keeping track of a score of said at least one player; and said at least one player entering a score for a hole of said golf course into said scoring mechanism.

11. The method of claim 5 wherein said graphical representation of a golf course includes eighteen golf holes, each golf hole of said eighteen holes includes indicia indicating a distance to a pin of said golf hole, each said pin being surrounded by a plurality of concentric circles indicating a distance from one of said plurality of concentric circles to said pin.

12. The method of claim 5 wherein said game board has atop surface and a bottom surface, said top surface has a graphical representation of a front nine holes and said bottom surface has a graphical representation of a back nine holes.

13. The method of claim 5 further comprising the steps of:

providing at least one card dispenser defining a plurality of receptacles dimensioned to retain said plurality of cards, each of said plurality of receptacles having said category of a specific golf shot; and said at least one player selecting one of said plurality of cards from a category corresponding to a specific golf shot that said at least one player must make to advance said player token through a specific golf hole of said golf course of said game board.

14. The method of claim 13 wherein said at least one card dispenser defines a plurality of receptacles having a category of at least one of a par 5 tee shot, a par 4 tee shot, a par 3 tee shot, a par 5 go for it, a par 5 lay up, a 2nd shot under 100 yards, a 3rd shot over 100 yards, a trouble shot, a chip shot, a bunker shot, and putting.

15. The method of claim 14 further comprising the steps of:

providing a card dispenser, said card dispenser defining:

a first receptacle dimensioned to retain cards for a par 5 tee shot;

a second receptacle dimensioned to retain cards for a par 4 tee shot;

a third receptacle dimensioned to retain cards for a par 3 tee shot;

a fourth receptacle dimensioned to retain cards for a par 5 2nd shot attempt at the green;

a fifth receptacle dimensioned to retain cards for a par 5 2nd shot attempt to lay up;

a sixth receptacle dimensioned to retain cards for a 2nd shot if under 100 yards from a pin of said golf hole and a third shot if over 100 yards from said pin of said golf hole;

a seventh receptacle dimensioned to retain cards for a trouble shot;

a eight receptacle dimensioned to retain cards for a chip shot;

a ninth receptacle dimensioned to retain cards for a bunker shot; and a tenth receptacle dimensioned to retain cards for a putting attempt;

said at least one player selecting one of said plurality of cards from one of said first receptacle, second receptacle, third receptacle, fourth receptacle and fifth receptacle from one of said first card dispenser and said second card dispenser corresponding to a specific golf shot that said at least one player faces in order to advance said player token through a specific golf hole of said golf course of said game board.

* * * * *